US005410796A

United States Patent [19]

Weeks, Jr.

[11] Patent Number: 5,410,796

[45] Date of Patent: May 2, 1995

[54] COPPER/COPPER ALLOY AND GRAPHITE FIBER COMPOSITE AND METHOD

[75] Inventor: Joseph K. Weeks, Jr., Salt Lake City, Utah

[73] Assignee: Technical Research Associates, Inc., Salt Lake City, Utah

[21] Appl. No.: 132,472

[22] Filed: Oct. 6, 1993

[51] Int. Cl.[6] ..... B21C 37/06

[52] U.S. Cl. ..... 29/419.1; 164/98; 228/190

[58] Field of Search ..... 228/190, 124; 29/419.1; 164/91, 98

[56] References Cited

U.S. PATENT DOCUMENTS 3,553,820 1/1971 Sara ..... 29/419.1 X
3,827,129 8/1974 Denham et al. ..... 29/419.1
3,918,141 11/1975 Pepper et al. ..... 29/419.1
4,724,669 2/1988 Kanehira et al. ..... 29/419.1 X
5,244,748 9/1993 Weeks et al. ..... 428/614

*Primary Examiner*—Kenneth J. Ramsey
*Attorney, Agent, or Firm*—J. Winslow Young

[57] ABSTRACT

A method for producing a composite having graphite fibers in a matrix of copper/copper alloy. The graphite fibers are coated with a refractory metal which both protects the graphite fibers from the molten copper/-copper alloy while also acting as a wetting agent on the graphite fibers for intimate infiltration by the molten copper/copper alloy. The coated graphite fibers are prepared in a structure and placed against a copper/-copper alloy element which is melted to produce the molten copper/copper alloy. The infiltration of the graphite fiber structure with the molten copper/copper alloy is characterized by the absence of pressure on the molten copper/copper alloy.

13 Claims, 4 Drawing Sheets

COPPER/COPPER ALLOY AND GRAPHITE FIBER COMPOSITE AND METHOD

GOVERNMENT RIGHTS

The present invention was made at least in part as a result of support received from the Naval Systems Command, United States Navy, Contract No. N00024-92-C-4332, and the United States of America has certain nonexclusive rights to this invention pursuant to this support.

BACKGROUND

1. Field of the Invention

This invention relates to a metal and graphite fiber composite produced by molten copper/copper alloy metal infiltration of graphite fibers, and more particularly, to a novel composite having a copper/copper alloy matrix with a reinforcement of graphite fibers for improved strength and heat transfer at a decreased weight.

2. The Prior Art

Numerous applications require a material of construction having the characteristics of high thermal conductivity, high strength, and relatively low weight. For example one application for a material of construction having these characteristics is a fuel handling system for certain types of advanced aircraft engines wherein the fuel is heated rapidly immediately prior to its entering the combustion chamber. The low weight requirement is, of course, self evident from its application. High strength is necessary when dealing with such exotic fuels as high-pressure hydrogen while high thermal conductivity is necessary to assure adequate heat transfer into the hydrogen prior to its introduction into the combustion chamber.

Additionally, since the invention of gun powder many centuries ago, numerous advances have been made not only in the types of propellants for use in a gun but also in the gun itself. These advances have included high velocity/pressure propellants which have required corresponding increases in the strength of the gun barrel to withstand the extreme pressures generated by these advanced propellants. Customarily, improvements in gun barrel strength are accomplished by improvements in the type and total mass of the steel or other metal alloys from which the gun barrel is fabricated. However, this increase in the mass of these advanced gun barrels increases the weight to unacceptable limits for certain applications. Certain advanced propellants have also been known to cause melting of the surface of the bore surface in the absence of adequate heat transfer even with the firing of a single round. Advanced propellants along with rapid firing cycles generate excessive amounts of thermal energy which must be dissipated adequately in order to prevent thermal degradation of the gun barrel. Heat buildup can cause premature initiation of the propellant in the next round brought into the firing chamber during the rapid firing sequences. Accordingly, the low thermal conductivity of conventional as well as advanced steel alloys limits the duration of the firing burst.

A material to provide these desired strength and heat transfer capabilities would be a composite material prepared from a graphite fiber reinforced copper/copper alloy matrix. The graphite fibers are prepared in the desired configuration and then infiltrated with molten copper/copper alloy. Graphite fibers have strength levels similar to or greater than metal fibers although they have a density significantly less than correspondingly-sized metal fibers so that the specific strength of graphite fibers on a weight-to-weight basis is several times that of metal fibers. Graphite fibers also have a higher modulus of elasticity which will result in stiffer composite structures. Graphite fibers also have desirable high temperature properties superior to those of other reinforcing fibers. The coefficient of thermal expansion is lower in graphite fibers so that the composite is more stable dimensionally when subjected to thermal cycling. Pitch-based graphite fibers have a very high thermal conductivity along the axis of the fiber thereby providing a composite having even superior thermal properties. Additionally, the high conductivity of the copper matrix provides excellent thermal conductivity transverse to the graphite fibers.

Historically, the production of graphite fiber reinforced metal composites required the infiltration of the fibers with the molten metal under high pressure. This process is referred to as "squeeze casting" or "pressure casting". The graphite fiber in the resultant composite was not actually wetted by the metal matrix in many cases, so that any bonding between the fiber and the metal was strictly a physical bonding and not a chemical bonding of metal to fiber. Although conceptually simple, pressure casting is difficult to implement since it requires handling molten metal under high pressure. Another problem with this process is that adjacent, closely packed graphite fibers tend to form a capillary that inhibits infiltration by the molten metal. These resulting voids between the fibers degrade the transverse strength of the matrix. High pressures are especially required to infiltrate thick sections of composite and some of the graphite fibers in the prestructure are displaced during the high pressure infiltration.

Further, since the graphite fibers are not actually wetted by this pressure consolidation processes, only the mechanical forces imposed on the metal matrix join the graphite fibers together in the composite. Inherently, these "bonding" forces are weak because of the lack of atom-to-atom bonding between the metal and the fiber.

An alternative to infiltration of graphite fibers with high pressure molten metal is to consolidate graphite fibers plated with metal either by hot pressing or hot isostatic pressing. Large parts can be formed only with difficulty using this approach. For example, one possible consolidation cycle for copper plated graphite fibers is 1000 psi pressure at 750° C. for 20 minutes. Attempts to produce composite tubes by the applications of external pressure can cause the graphite fibers forming the tube to be compressed laterally and buckle, lending to poor hoop strength properties.

Perhaps one of the more significant problems with copper/copper alloy composites reinforced with graphite fibers is that the graphite fibers dewet from the copper upon exposure to high temperature. This causes the formation of voids in and the swelling of the composite part when exposed to continuous high temperatures or thermal cycling. See, Hutto et al, "Development of Copper-Graphite Composites from Metal Coated Carbon Fibers," 31*st International SAMPE Symposium* 1145–1153, Apr. 7–10, 1986.

An alternative technology to high pressure consolidation is infiltration of the reinforcing graphite fibers with molten metal at lower pressures. Under these conditions it is necessary to wet the surface of the graphite fibers with the molten metal. If the graphite fibers are wetted by the molten metal, capillary action between adjacent graphite fibers will draw the molten metal into the fibers. The technical background for producing metal matrix composites by molten metal infiltration has been reviewed by Delannay et al., "The Wetting of Carbon by Copper and Copper Alloys," *Journal of Material Sciences* 149–155 (1987).

The advantage of wetting the graphite fibers with the molten metal is that the metal as a liquid infiltrate creates a chemical bonding between the metal and the graphite fibers (as opposed to mere mechanical bonding as from pressure casting) thereby providing the fiber/-metal composite with superior physical properties. Complete infiltration of the graphite fibers with molten metal requires that the graphite fibers must be wetted by the molten metal or metal alloy. However, most metals and metal alloys which will wet the graphite fibers are metals which react with carbon or the graphite form of carbon to form stable metal carbides. Thus, in the process of wetting the graphite fibers, the carbide-forming elements in the infiltrating metal or metal alloy may react in an uncontrolled manner with the graphite fibers, degrading the properties of the graphite fibers. This problem has been addressed by a separate patent of which I am a co-inventor (U.S. Pat. No. 5,244,748 issued 14 Sep. 1993) wherein a barrier layer was interposed between the wetting layer and the graphite fiber, the barrier layer being designed to protect the graphite fiber from attack by the wetting layer.

The production of composite structures of graphite fibers in a copper matrix constitutes a significant problem since pure graphite fibers are not wetted by pure molten copper. At least two approaches have been suggested in the prior art for improving wettability. One approach is to coat the surface of the graphite fiber with a chemical layer that promotes wetting. The other approach is to develop an alloy matrix material that will wet the graphite fiber. Chromium and titanium have been added to the molten copper infiltrate to improve graphite fiber wetting and/or bonding. The concentration of these wetting agents must be maintained at a low level or the processing time at high temperature must be minimized to prevent significant levels of reaction between the graphite fibers and the copper infiltrate thus limiting the strength and utility of the composite. Additionally, the addition of alloying agents may decrease the thermal and electrical conductivity of the metal matrix.

There are many examples in the art of coating graphite fibers either to protect the fibers or to provide for a wetting action on the graphite fiber surface. Various techniques to accomplish this purpose are known in the art and include, for example, using silica as set forth in the foregoing patent to coat graphite fibers in order to subsequently wet the fibers with molten magnesium, aluminum alloys and/or copper/copper alloys. Nickel coatings are readily wetted by molten copper although the molten copper readily dissolves the nickel. Titanium boron coated on graphite fibers will enhance wetting between graphite fibers and a number of molten metals, however these coatings must not be exposed to the air prior to infiltration otherwise the enhanced wetting properties are lost. The requirement that this coating not be exposed to air limits the configuration of composites which can be formed using this coating.

In view of the foregoing, it would be an advancement in the art to provide a technique for producing metal matrix composites by a low pressure liquid infiltration process. Further, it would be an advancement in the art to provide a fiber coating which is stable in the air and which is spontaneously wet by liquid metals, particularly, if the coating allows thick sections of composite to be formed. Such a coating would allow the production of filament wound composites, as well as composites in which the fibers are woven into a structure. It would be also an advancement in the art to use these composites to provide a tube that is lighter in weight while retaining the strength characteristics of a tube fabricated from an alloy steel. It would also be an advancement in the art to provide a high-temperature device such as a gun barrel having a major portion of the alloy steel replaced with a graphite fiber and copper matrix as a gun barrel jacket with a hard, heat resistant liner. It would also be an advancement in the art to provide a method for fabricating a gun barrel wherein a metal alloy or ceramic gun barrel blank or liner is wound with graphite fibers and the graphite fibers wetted with molten copper. Another advancement in the art would be to provide a process that can be used to produce a strong, lighter weight structure having improved strength and heat transfer capabilities.

Such a novel composite and method is disclosed and claimed in this application.

BRIEF SUMMARY AND OBJECTS OF THE INVENTION

This invention is a copper/copper alloy and graphite fiber composite wherein the graphite fibers are wetted with a copper/copper alloy. The graphite fibers are coated with a refractory metal and/or its metal carbide form, the refractory metals including molybdenum, tungsten, tantalum, and niobium. The refractory metal coating on the graphite fibers acts as a wetting agent for the molten copper/copper alloy. The coated graphite fibers are infiltrated with molten copper/copper alloy to produce a solid composite having improved strength characteristics coupled with increased heat transfer characteristics.

It is, therefore, a primary object of this invention to provide improvements in copper-based graphite fiber composites.

Another object of this invention is to provide improvements in the method of infiltrating a molten copper/copper alloy into a graphite fiber matrix to produce a graphite fiber and copper/copper alloy composite.

Another object of this invention is to provide a structure fabricated from a base around which graphite fibers have been wound and wetted with molten copper/copper alloy.

Another object of this invention is to provide a process for protecting graphite fibers against attack by molten copper or certain alloys of copper by coating the graphite fibers with a refractory metal prior to contact by the molten copper/copper alloy.

Another object of this invention is to produce a graphite fiber and copper/copper alloy composite wherein the graphite fibers are coated with a refractory metal coating in the absence of a barrier layer between the refractory metal coating and the graphite fiber.

Another object of this invention is to coat the graphite fibers of a composite structure with a refractory metal or its metal carbide form, the refractory metal being selected from molybdenum, tungsten, tantalum, and niobium, the refractory metal coating wetting the graphite fibers for a copper/copper alloy matrix of the composite.

Another object of this invention is to produce a composite tube formed from a graphite fiber structure infiltrated with a molten copper/copper alloy.

Another object of this invention is to produce a composite tube having a copper/copper alloy matrix with a reinforcement of graphite fibers wherein coated graphite fibers are formed about a tube of the copper/copper alloy and then heated to cause the copper/copper alloy of the tube to melt and infiltrate the graphite fibers.

These and other objects and features of the present invention will become more readily apparent from the following description in which preferred and other embodiments of the invention have been set forth in conjunction with the accompanying drawing and appended claims.

DETAILED DESCRIPTION OF THE PREFERRED EMBODIMENT

Figure 1:
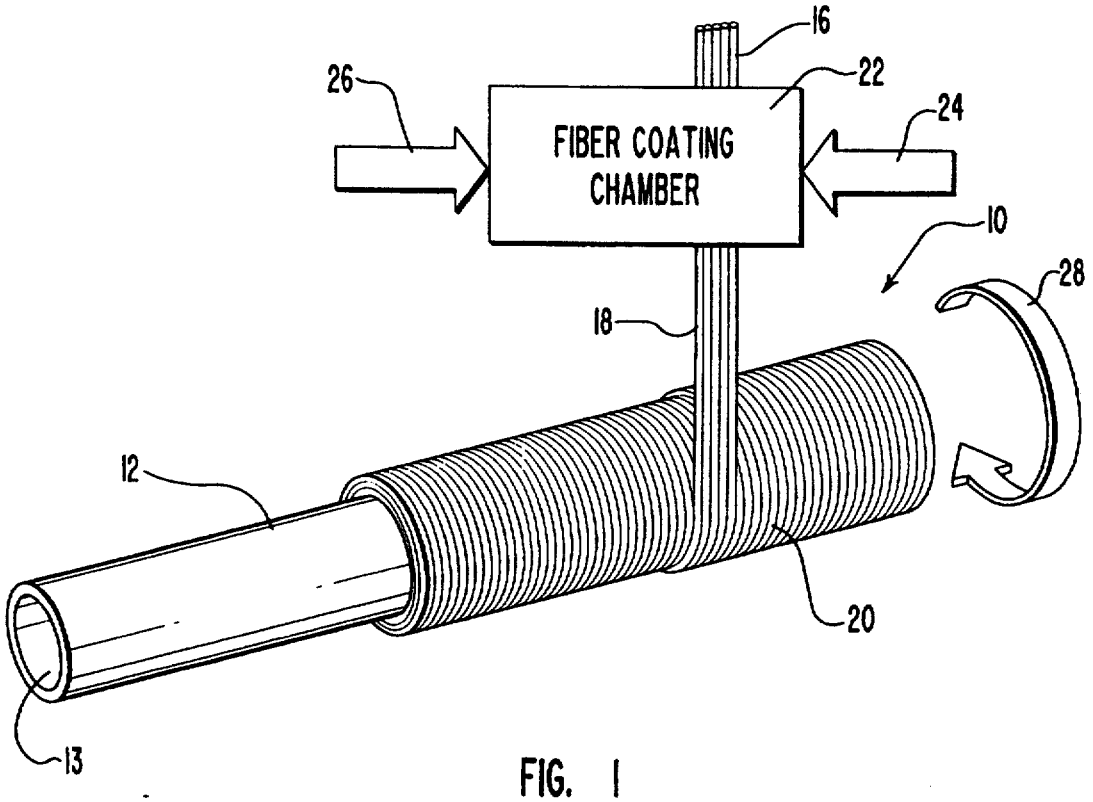
FIG. 1 is a perspective view of a schematic of a gun barrel blank being wound with graphite fibers, the graphite fibers having been specially coated with a wetting agent.

The invention is best understood by reference to the drawing wherein like parts are designated by like numerals throughout in conjunction with the following description.

GENERAL DISCUSSION

The novel composite structure of this invention is fabricated by forming specially prepared graphite fibers into the desired configuration and then infiltrating the graphite fibers with a molten copper/copper alloy. The alloy forms of copper presently preferred for the practice of this invention are the copper alloys that include beryllium or silver, depending upon the particular characteristics desired for the resultant copper alloy. The graphite fibers are coated with a refractory metal and/or its metal carbide form, the refractory metals being selected from molybdenum, tungsten, tantalum, and niobium. These refractory metals allow the molten copper/copper alloy to wet the graphite fibers. The graphite fibers are coated with the refractory metal coating through any one of the conventional techniques such as those involving sputtering or chemical vapor deposition. In sputtering, the graphite fiber is passed through a vacuum chamber in which an electron beam is directed at a refractory metal target. The electron beam causes molecules of the refractory metal to be ejected from the target and form a metallic coat on the passing graphite fiber. Multiple targets, rotation of the targets and spreading of the fiber tow allows the fibers to be completely and continuously coated.

In the chemical vapor deposition process an electric current is directed through the graphite fiber as it passes through a chamber containing an atmosphere of a gaseous form of refractory metal. These gaseous forms include, for example, molybdenum pentachloride, tungsten hexachloride, tungsten hexafluoride, tantalum pentachloride, and niobium pentachloride as well as the carbonyl forms, where available, for these refractory metals. When the chloride or fluoride form of the refractory metal is used, hydrogen is added to the chamber to scavenge the chlorine. The heating process deposits the refractory metal on the graphite fibers where it either remains in the metallic form or reacts in a limited fashion with the carbon of the graphite fiber to form a carbide of the refractory metal. However, great care is taken to preclude excessive formation of these carbides since excessive reaction between the carbon and the refractory metal could destroy the integrity of the graphite fibers. Some carbide formation may be used to control the bonding between the fibers and the refractory metal coating. The refractory metal coating is also thin to avoid excessively increasing the weight of the composite.

The coated graphite fibers are then formed into the structure using conventional techniques. The graphite fiber structure is now ready to be wetted with the molten copper/copper alloy to produce the novel composite structure of this invention. Advantageously, the presence of the refractory metal/refractory metal carbide coating on the graphite fibers renders the graphite fibers readily amenable to wetting by the molten copper/copper alloy. At the present time it is not possible to state categorically why the presence of the refractory metal/refractory metal carbide coating provides such a superior wetting action by the molten copper/copper alloy, but it readily produces a solid graphite fiber and copper/copper alloy composite that is free from voids. Further, another important aspect of this invention is that the refractory metal is present on the graphite fibers in the absence of any barrier type materials such as silica or the like. The absence of the barrier coating provides a stronger bond between the graphite fibers and the copper/copper alloy than would otherwise be possible with another intervening material which could interfere with the bonding process between the graphite fibers and the copper/copper alloy.

It should be noted at this point that others have coated graphite fibers with molybdenum to improve bonding and to increase the high temperature stability of the composite. However, the use of continuous coatings of molybdenum/molybdenum carbide coatings on graphite fibers to produce composites by low pressure liquid metal infiltration techniques is novel.

DETAILED DESCRIPTION

Figure 2:
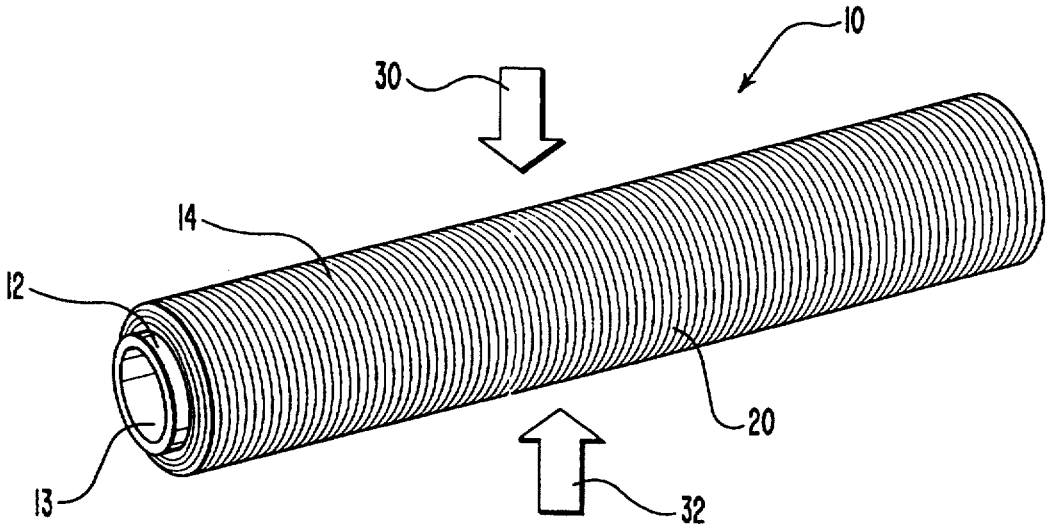
FIG. 2 is a perspective view of a schematic of the wound gun barrel blank being infiltrated with molten copper.
Figure 3:
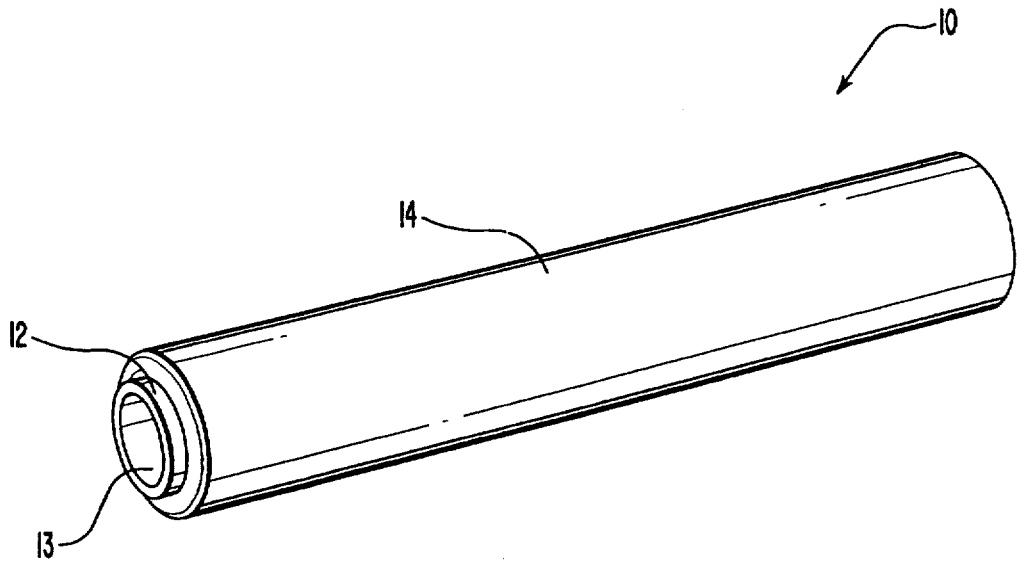
FIG. 3 is a perspective view of a fragment of a completed, composite gun barrel produced by this invention.

Referring now to FIGS. 1–3, the novel composite structure produced by this invention is a gun barrel shown generally at 10 (FIG. 3) and includes a gun barrel blank 12 (FIGS. 1 and 2) with a graphite fiber and copper/copper alloy composite 14 formed thereon from a fiber winding 20 of coated graphite fibers 18 wetted with a molten copper/copper alloy 30. Gun barrel blank 12 is prepared from a cylindrical billet or rod of metal alloy with sufficient external diameter to accommodate bore 13 being drilled coaxially through gun barrel blank 12 to turn gun barrel blank 12 into a gun barrel tube or liner 12*a* (FIG. 3). Gun barrel tube 12*a* has a relatively thin tube wall surrounding bore 13 and is intended primarily to provide the necessary wear surface and high temperature resistance of a gun barrel since the major portion of the required strength for composite gun barrel 10 is provided by graphite fiber and copper/copper alloy composite 14. Preferentially, bore 13 is drilled and rifled after graphite fiber and copper/copper alloy composite 14 has been formed about gun barrel blank 12 due to the temperatures involved during the infiltration of graphite fiber winding 20 with molten copper/copper alloy 30.

Coated graphite fibers 18 are produced from graphite fibers 16 that are coated with a refractory metal coating in a fiber coating chamber 22. Fiber coating chamber 22 can be any suitable processor for producing a refractory metal coating on graphite fibers 16. In one embodiment, fiber coating chamber 22 is configured as a conventional, prior art, sputtering chamber wherein an electron beam (not shown) from an electrical source 26 is directed against a refractory metal target (not shown) creating a stream of refractory metal atoms which coat graphite fibers 16 to produce coated graphite fibers 18. In another embodiment of this invention, fiber coating chamber 22 is configured as a conventional, prior art, chemical vapor deposition chamber into which a gaseous form of the refractory metal is introduced as refractory metal source 24. For example, any one of molybdenum carbonyl, molybdenum pentachloride, tungsten hexachloride, tungsten hexafluoride, tantalum pentachloride, and niobium pentachloride, can be introduced as refractory metal source 24 into fiber coating chamber 22. Where the chloride or fluoride forms of these refractory metals are used, hydrogen is also introduced into fiber coating chamber 22 to scavenge the chlorine or fluorine released during the reaction between the refractory metal and graphite fibers 16. Entering graphite fibers 16 are heated by a current from electrical source 26 to cause graphite fibers 16 to become coated with molybdenum to form coated graphite fibers 18.

The foregoing sputtering and chemical vapor deposition processes are well known processes in the art and are described herein to set forth at least two embodiments for creating the refractory metal coating on graphite fibers 16 to produce coated graphite fibers 18. All that is essential is that the fibers are substantially completely coated with a coating of refractory metal or refractory metal carbide or combinations thereof which is both adherent and continuous.

Coated graphite fibers 18 are wound on gun barrel blank 12 to produce fiber winding 20. The gun barrel blank 12 is preferably composed of a material which does not readily react with graphite fibers near the melting point of copper/copper alloy 30. The precise geometry of fiber winding 20 is any suitable, conventional winding geometry from prior art fiber winding technology to produce a composite with the desired strength and coefficient of thermal expansion. The only concern is to assure the proper ratio between coated graphite fiber 18 and copper/copper alloy 30 as determined by its ultimate application.

Referring specifically to FIG. 2, gun barrel blank 12 with fiber winding 20 thereon is heated as indicated schematically by heat arrow 32 while molten copper/copper alloy 30 is introduced into fiber winding 20. The refractory metal coating on coated fibers 18 which constitute fiber winding 20 acts as a wetting agent to cause copper/copper alloy 30 to intimately infiltrate fiber winding 20. This produces graphite fiber and copper/copper alloy composite jacket 14 on gun barrel blank 12 to form the basic structure for composite gun barrel 10 (FIG. 3). Composite gun barrel 10 is now ready to be machined to create bore 13 and to be assembled into the rest of the framework (not shown) to form the particular gun of which composite gun barrel 10 is such a critical component.

Advantageously, composite gun barrel 10 is lighter in weight than a conventional gun barrel (not-shown) fabricated from alloy gun barrel steel. Composite gun barrel 10 is also stronger than a conventional gun barrel having the same physical dimensions. However, perhaps one of the most important aspects of composite gun barrel 10 is that the copper/copper alloy portion of graphite fiber and copper/copper alloy composite 14 transfers heat energy much more efficiently than conventional alloy steels thereby allowing the bore temperature to decrease more rapidly than with other gun barrel materials. Further, the presence of graphite fibers 16 provides graphite fiber and copper/copper alloy composite 14 with the desired strength and thermal expansion characteristics at high temperatures even though composite gun barrel 10 will become quite hot during sustained, rapid fire sequences. This is extremely important since heat not only directly affects the use to which composite gun barrel 10 is put, but also to its accuracy and ease of use.

Figure 4:
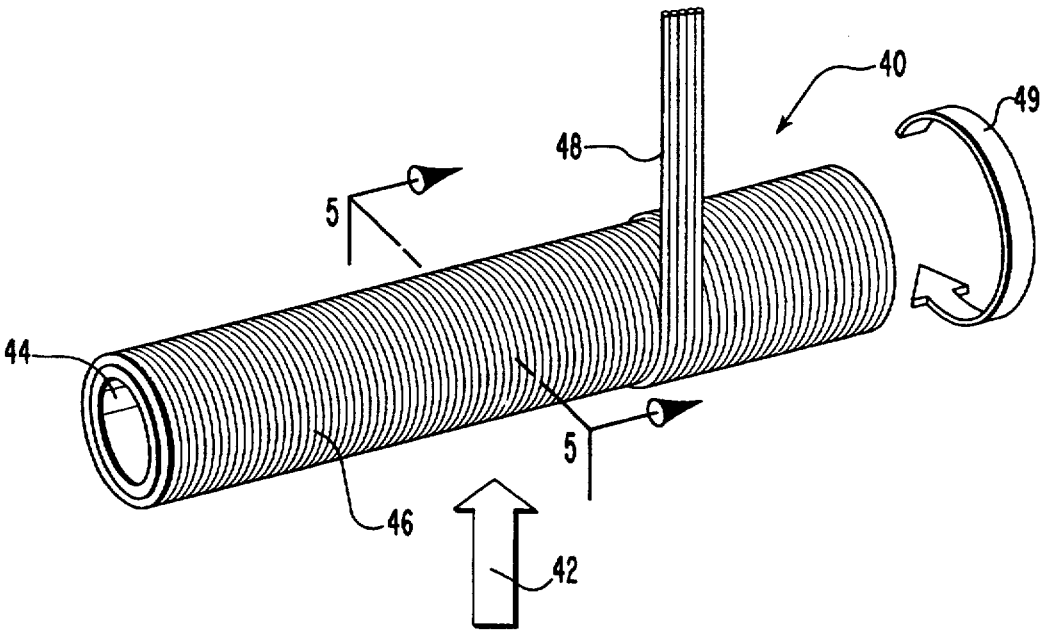
FIG. 4 is a perspective view of a graphite fiber winding about a metal tube and being heated.
Figure 5:
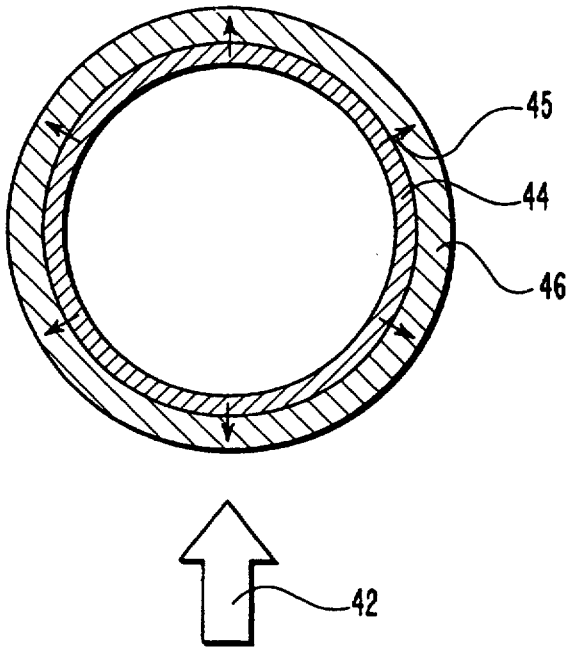
FIG. 5 is an enlarged cross sectional view taken along lines 5—5 of FIG. 4 to schematically illustrate the infiltration of the metal from the metal tube into the surrounding graphite fiber winding.
Figure 6:
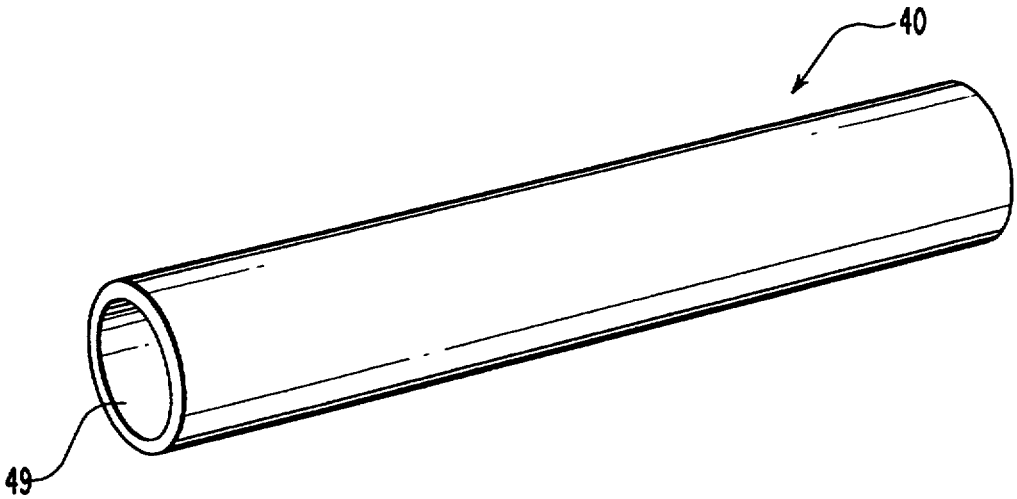
FIG. 6 is a perspective view of the composite tube formed by the process of FIGS. 4 and 5.

Referring now to FIGS. 4–6, a second, novel composite structure of this invention is shown as a composite tube 40 (FIG. 6) fabricated from a graphite fiber winding 46 formed about a tube 44. Tube 44 is fabricated from a copper/copper alloy. Fiber winding 46 was prepared from graphite fibers 48 coated with a refractory metal/refractory metal carbide coating such as coated graphite fibers 18 (FIG. 1). This refractory metal/refractory metal carbide coating is prepared using the previously described, prior art sputtering or vapor deposition techniques or any other suitable process for producing coated graphite fibers 48. Tube 44 was rotated as indicated by arrow 49 to produce graphite fiber winding 46 thereon.

Referring specifically to FIG. 5, tube 44 and graphite fiber winding 46 are subjected to heat as shown schematically by arrow 42. Heat 42 causes the copper/copper alloy metal of tube 44 to melt and infiltrate the surrounding graphite fiber winding 46. Tube 44 essentially disappears into graphite fiber winding 46 as shown schematically at infiltration arrows 45. The resultant product was composite tube 40 having a lumen 49 with a diameter that is approximately the same as the external diameter of tube 44.

Figure 7:
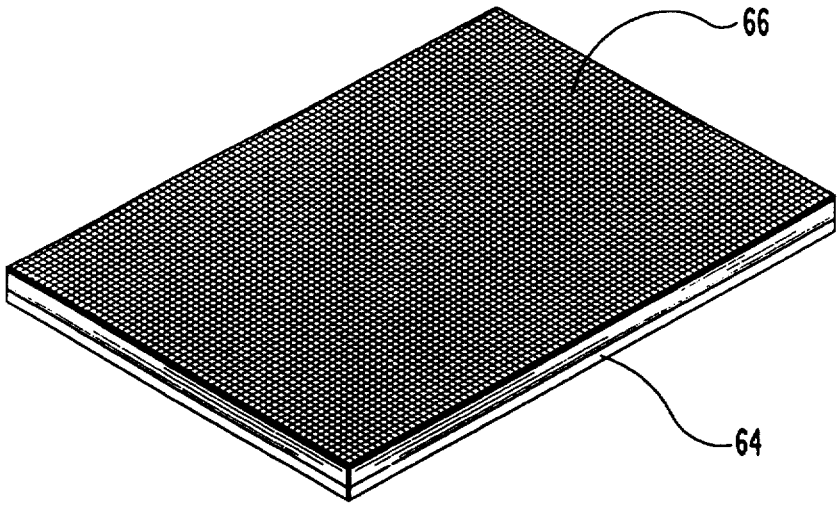
FIG. 7 is a perspective view of a graphite fiber structure and a metal substrate.
Figure 8:
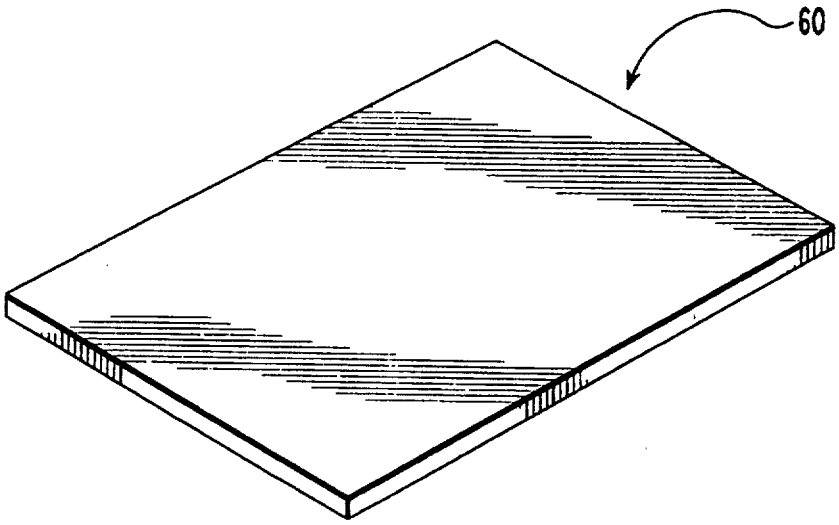
FIG. 8 is a perspective view of the graphite fiber structure of FIG. 7 infiltrated with the metal of the metal substrate.

Referring now to FIGS. 7 and 8, a third, novel composite structure of this invention is shown generally at 60 (FIG. 8) as a composite slab. Composite slab 60 was fabricated from a graphite fiber element 66 in juxtaposition with a sheet 64. Graphite fiber element 66 was prepared either with a woven or a non-woven configuration from coated graphite fibers 18 (FIG. 1) or coated graphite fibers 48 (FIG. 4) produced as described hereinbefore. Selectively, graphite fiber element 66 was produced with either the woven or non-woven configuration and can be produced with any desired thickness limited only by the ability of the molten metal of sheet 64 to infiltrate and suitably wet the coated graphite fibers therein.

Sheet 64 was prepared from a copper/copper alloy and was melted by heat 62 (shown schematically as heat arrow 62) to cause the molten copper/copper alloy from sheet 64 to infiltrate graphite fiber element 66. Importantly, the graphite fibers that constitute graphite fiber element 66 are suitably coated with the foregoing refractory metal and/or refractory metal carbide as described hereinbefore in order to achieve the desired degree of wetting of the graphite fibers with the molten metal from sheet 64.

The following examples are representative of the novel apparatus and method of this invention but are not restrictive as to the scope of the claims:

EXAMPLE 1

A graphite fiber tow of Amoco Performance Products pitch based fibers (type P-100) consisting of 2,000 filaments was placed in a tubular vessel along with a boat containing molybdenum pentachloride. The vessel was purged with hydrogen and heated by means of an external heater to approximately 300° C. The fiber tow was heated to approximately 800° C. by passing an electric current through it. Molybdenum pentachloride which vaporized as a result of the externally applied heat reacted with the hydrogen in the vessel depositing a layer of molybdenum on the surface of the graphite fibers.

One end of a two inch length of the molybdenum coated graphite fiber tow was placed in a one half inch length of copper tubing one eighth inch in outside diameter. One and one half inches of fiber tow protruded from the tubing. The coated fiber tow and copper tubing were placed in a vacuum oven and heated until the copper tubing melted. After five minutes the sample was cooled and examined. The copper completely infiltrated the graphite fiber tow the full two inch length of the tow. Examination of cross-sectioned samples showed that the graphite filaments were completely surrounded by copper. The resulting sample was a successful composite rod of graphite fibers in a copper matrix.

EXAMPLE 2

A two inch long graphite fiber tow, similar to that in Example 1 but without the treatment in the molybdenum pentachloride, was placed in a one half inch length of one eight inch outside diameter tubing such that one and one half inches of fiber tow protruded from one end of the tubing. The tow and tube were placed in a vacuum oven and heated until the copper tubing melted. After five minutes, the sample was cooled and examined. The copper did not wet or coat the graphite fibers. The copper and graphite fibers were easily separated one from another.

EXAMPLE 3

A graphite fiber tow similar to that of Example 1 was coated with molybdenum using a similar process except that by modifying the process variables, a coating was produced which had cracks in the coating. These cracks were visible under an optical microscope. When the sample was placed in a copper tube and heated using the same technique as in Example 1, only the one half inch length of the fiber tow which was originally surrounded by the copper tube was infiltrated with copper. The one and one half inch length of fiber tow which protruded from the copper tube is largely devoid of any copper.

EXAMPLE 4

Graphite fibers were coated with a refractory metal by heating them in an atmosphere containing a volatile, refractory metal compound, similar to the process outlined in Example 1. The fibers were wound around a copper tube and the tube and fibers were heated in vacuum chamber until the copper melted. The sample was heated for an additional 5 minutes and then cooled. A composite tube consisting of graphite fibers in a copper matrix resulted. The inside diameter of the tube was approximately the same diameter as the outside diameter of the original copper tube.

EXAMPLE 5

Graphite fibers were wound around a copper tube and placed in a heated atmosphere containing a volatile molybdenum compound. The molybdenum compound produced a molybdenum coating on the graphite fibers. The fibers and tube were heated in vacuum to the melting point of copper. They were held at this temperature for an additional five minutes. Nitrogen was admitted into the vacuum oven to decrease the size and number of voids in the final composite tube. Upon cooling, a composite tube of copper and graphite fibers was produced. The inside of the tube was machined and the steel tube was press fit into the machined copper/graphite fiber composite tube to form a gun barrel segment.

EXAMPLE 6

Graphite fibers were wound around a metal tube and placed in a heated atmosphere containing a volatile, refractory metal compound to produce a refractory metal coating on the graphite fibers. Copper sheet was wound around the outside of the coated fibers. The fibers and tube were heated in a vacuum until the copper melted and infiltrated the coated graphite fibers. Upon cooling, a composite consisting of copper/graphite fiber surrounded and was bonded to the metal tube. The metal tube was then machined to produce a gun barrel segment.

EXAMPLE 7

Graphite fibers were coated with a refractory metal using techniques outlined in previous examples. The fibers were woven into a cloth. A sheet of copper/copper alloy was placed on the cloth and both were heated in a vacuum oven to the melting point of the copper/copper alloy. After five minutes, the copper/copper alloy had completely infiltrated the coated fibers to form a sheet of graphite fiber and copper/copper alloy composite.

EXAMPLE 8

Graphite fibers were woven into a cloth and coated with a refractory metal by placing the cloth in a heated atmosphere containing a volatile compound of the refractory metal. The fibers in the cloth were coated with the refractory metal. A sheet of copper/copper alloy was placed on the coated cloth as in Example 7 and heated until the copper/copper alloy infiltrated the coated fibers. A sheet of graphite fiber and copper/copper alloy composite was produced.

From the foregoing it is clear that various shapes or configurations of coated graphite fibers can be suitably wetted with molten copper/copper alloy without undue degradation of the integrity of the graphite fibers as long as the graphite fibers are adequately coated with the refractory metal. This invention thereby discloses the production of rods, tubes, and sheets formed as a composite of graphite fibers in a copper matrix.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A method for producing a structure from a graphite fiber composite with a copper/copper alloy matrix comprising the steps of:

coating graphite fibers with a refractory metal to produce a body of coated graphite fibers;

forming a structure with said body of coated graphite fibers, said forming step comprising preparing said structure as a structure selected from the group consisting of a winding body of said coated graphite fibers, a woven body of said coated graphite fibers, and a non-woven body of said coated graphite fibers, said preparing step further comprising forming said winding body by wrapping said coated graphite fibers about a cylindrical shape; and infiltrating said structure with molten copper/copper alloy, said copper/copper alloy wetting said coated graphite fibers thereby producing said graphite fiber composite with said copper/copper alloy matrix.

2. The method defined in claim 1 wherein said coating step comprises selecting said refractory metal from the group consisting of molybdenum, tungsten, tantalum, and niobium, and the carbide forms of said refractory metal.

3. The method defined in claim 1 wherein said wrapping step comprises obtaining said cylindrical shape as a tube of copper/copper alloy and infiltrating said coated graphite fibers with molten copper/copper alloy from said tube.

4. The method defined in claim 1 wherein said preparing step comprises mounting said body of said coated graphite fibers on a layer of copper/copper alloy and infiltrating said body of said coated graphite fibers with molten copper/copper alloy from said layer of copper/copper alloy.

5. The method defined in claim 1 wherein said infiltrating step includes cooling said molten copper/copper alloy below the melting point of said molten copper/copper alloy.

6. The method defined in claim 1 wherein said infiltrating step is characterized by the absence of pressure on said molten copper/copper alloy.

7. A method for producing a composite having a copper/copper alloy matrix with a reinforcement of graphite fibers comprising the steps of:

coating said graphite fibers with a refractory metal thereby producing coated graphite fibers;

selecting a copper/copper alloy base;

preparing a first structure from said copper/copper alloy base;

forming a second structure with said coated graphite fibers by conforming said coated graphite fibers to said first structure to prepare said second structure with a shape as determined by said first structure; and eliminating said first structure by infiltrating said second structure with molten copper/copper alloy from said first structure, said refractory metal forming a wetting agent for said coated graphite fibers for said molten copper/copper alloy, said second structure retaining said shape as determined by said first structure.

8. The method defined in claim 7 wherein said coating step comprises selecting said refractory metal from the group consisting of molybdenum, tungsten, tantalum, and niobium and the carbide forms of said refractory metal.

9. The method defined in claim 7 wherein said eliminating step is characterized by the absence of pressure on said molten copper/copper alloy.

10. The method defined in claim 7 wherein said eliminating step comprises cooling said molten copper/copper alloy below the melting point of said copper/copper alloy.

11. A method for preparing a structure from a composite of graphite fibers having a copper/copper alloy matrix comprising the steps of:

obtaining a body of graphite fibers;

coating said graphite fibers in said body of graphite fibers with a refractory metal;

selecting a copper/copper alloy base;

preparing a first structure from said copper/copper alloy base;

conforming said coated graphite fibers to said first structure to produce a second structure of coated graphite fibers;

melting said copper/copper alloy base;

infiltrating said body of graphite fibers with said molten copper/copper alloy, said copper/copper alloy wetting said graphite fibers; and removing said first structure from said second structure during said infiltrating step thereby leaving said second structure with the shape of said first structure.

12. The method defined in claim 11 wherein said infiltrating step is characterized by the absence of pressure on said molten copper/copper alloy.

13. The method defined in claim 11 wherein said infiltrating step comprises cooling said molten copper/copper alloy below the melting temperature of copper/copper alloy.

* * * * *